US010651560B2

(12) United States Patent
Roemer et al.

(10) Patent No.: US 10,651,560 B2
(45) Date of Patent: May 12, 2020

(54) WAVEGUIDE RADIATOR, ARRAY ANTENNA RADIATOR AND SYNTHETIC APERTURE RADAR SYSTEM

(71) Applicant: Astrium GmbH, Taufkirchen (DE)

(72) Inventors: Christian Roemer, Markdorf (DE); Alexander Herschlein, Rheinstetten (DE)

(73) Assignee: AIRBUS DS GMBH, Taufkirchen (DE)

( * ) Notice: Subject to any disclaimer, the term of this patent is extended or adjusted under 35 U.S.C. 154(b) by 143 days.

(21) Appl. No.: 14/340,077

(22) Filed: Jul. 24, 2014

(65) Prior Publication Data

US 2015/0029069 A1 Jan. 29, 2015

(30) Foreign Application Priority Data

Jul. 25, 2013 (DE) ..... 10 2013 012 315

(51) Int. Cl.

| | |
|---|---|
| ***H01Q 13/10*** | (2006.01) |
| ***H01Q 13/18*** | (2006.01) |
| ***H01Q 13/20*** | (2006.01) |
| ***H01Q 21/00*** | (2006.01) |
| ***H01Q 1/50*** | (2006.01) |

(52) U.S. Cl.

CPC ..... *H01Q 13/18* (2013.01); *H01Q 1/50* (2013.01); *H01Q 13/203* (2013.01); *H01Q 21/005* (2013.01)

(58) Field of Classification Search

CPC ..... H01Q 13/18; H01Q 1/50; H01Q 21/005; H01Q 13/203

USPC ..... 343/771

See application file for complete search history.

(56) References Cited

U.S. PATENT DOCUMENTS

| | | | | |
|---|---|---|---|---|
| 2,914,766 A | | 11/1959 | Butler | |
| 3,106,713 A | * | 10/1963 | Murata | H01Q 13/203 333/237 |
| 3,193,830 A | * | 7/1965 | Provencher | H01Q 13/20 343/771 |
| 3,224,004 A | * | 12/1965 | Barthez | H01P 3/123 333/239 |

(Continued)

FOREIGN PATENT DOCUMENTS

| | | |
|---|---|---|
| DE | 10 2006 057 144 A1 | 7/2008 |
| WO | WO 2008/064655 A1 | 6/2008 |

OTHER PUBLICATIONS

Roemer, Christian: Slotted waveguide in phased array antennas. Karlsruhe: IHE, 2008 (Forschungsberichte aus dem Institut fuer Hoechstfrequenztechnik und Elektronik der Universitaet Karlsruhe ; 55). 159 S.—Zugl.: Karlsruhe, Univ., Diss., 2008, (Forty (40) pages).

(Continued)

*Primary Examiner* — Dieu Hien T Duong
*Assistant Examiner* — Bamidele A Jegede
(74) *Attorney, Agent, or Firm* — Crowell & Moring LLP

(57) ABSTRACT

A waveguide radiator includes a slotted waveguide with a plurality of transverse or longitudinal slots provided in the waveguide and an additional inner conductor provided in the waveguide. The inner conductor is formed, depending on the alignment of the slots in such a manner that the result is a feed according to the traveling wave principle, wherein all slots of the waveguide can be excited with identical phase.

11 Claims, 5 Drawing Sheets

(56) References Cited

U.S. PATENT DOCUMENTS 3,599,216 A * 8/1971 Paine ..... H01Q 21/005 343/771
3,688,225 A * 8/1972 Cohn ..... H01P 1/2016 333/204
3,696,433 A * 10/1972 Killion ..... H01Q 13/10 343/770
3,697,993 A * 10/1972 Jones ..... G01S 13/53 342/161
3,701,162 A * 10/1972 Seaton ..... H01Q 13/20 343/771
4,160,145 A * 7/1979 Rueggeberg ..... H05B 6/78 219/691
4,197,549 A * 4/1980 Collins ..... H01Q 21/0062 343/771
4,243,990 A * 1/1981 Nemit ..... H01Q 5/42 343/770
4,409,595 A * 10/1983 Park ..... H01Q 21/0043 343/771
4,435,715 A * 3/1984 Ajioka ..... H01Q 21/0043 343/771
5,010,351 A * 4/1991 Kelly ..... H01Q 21/064 343/771
5,170,174 A * 12/1992 Caer ..... H01Q 13/10 343/771
5,483,248 A * 1/1996 Milroy ..... H01Q 13/20 343/767
5,541,612 A * 7/1996 Josefsson ..... H01Q 21/0043 333/237
5,650,793 A * 7/1997 Park ..... H01Q 21/005 333/114
5,714,962 A * 2/1998 Josefsson ..... H01Q 1/523 343/770
5,831,583 A * 11/1998 Lagerstedt ..... H01Q 21/005 343/771
5,914,694 A * 6/1999 Raab ..... H01Q 13/22 343/725
5,990,844 A * 11/1999 Dumont ..... H01Q 21/0043 29/600
6,166,701 A * 12/2000 Park ..... H01Q 21/0037 333/21 A
6,201,507 B1 * 3/2001 Park ..... H01Q 13/22 333/137
6,304,228 B1 * 10/2001 Smith ..... H01Q 1/288 343/770
6,535,173 B2 * 3/2003 Ou ..... H01Q 21/005 343/770
6,731,241 B2 * 5/2004 Park ..... H01Q 21/0006 342/361
7,109,928 B1 * 9/2006 Thiele ..... H01Q 1/38 343/700 MS
8,149,177 B1 * 4/2012 Callus ..... H01Q 1/286 343/705
8,493,275 B2 7/2013 Roemer
2005/0146477 A1 * 7/2005 Kelly ..... H01Q 1/3275 343/771
2006/0001586 A1 * 1/2006 Chen ..... H01Q 21/005 343/770
2006/0132374 A1 * 6/2006 Wang ..... H01Q 1/3275 343/770
2007/0296639 A1 * 12/2007 Hook ..... H01Q 13/0241 343/767
2010/0001916 A1 * 1/2010 Yamaguchi ..... H01Q 13/12 343/771
2010/0026584 A1 * 2/2010 Nakabayashi ..... H01Q 21/0075 343/700 MS
2010/0066623 A1 * 3/2010 Roemer ..... H01Q 21/0043 343/771
2010/0231475 A1 * 9/2010 Ou ..... H01Q 13/0258 343/776
2014/0292603 A1 * 10/2014 Thomas ..... H01Q 1/007 343/771

OTHER PUBLICATIONS

German-language European Search Report dated Dec. 19, 2014, with partial English translation (fifteen (15) pages).
Christian Roemer, "Slotted Waveguide Structures in Phased Array Antennas", Forschungsberichte aus dem Institut fuer Hoechstfrequenztechnik und Elektronik der Universitat Karlsruhe, Feb. 29, 2008 (177 pages).
Satoshi Yamaguchi et al., "Inclined Slot Array Antennas on a Rectangular Coaxial Line", Proceedings of the 5th European Conference on Antennas and Propagation (EUCAP), Apr. 11, 2011, pp. 1036-1040.
Canadian Office Action issued in Canadian counterpart application No. 2,857,658 dated Jun. 21, 2017 (Four (4) pages).

* cited by examiner

WAVEGUIDE RADIATOR, ARRAY ANTENNA RADIATOR AND SYNTHETIC APERTURE RADAR SYSTEM

CROSS-REFERENCE TO RELATED APPLICATIONS

This application claims priority under 35 U.S.C. § 119 to German application number 10 2013 012 315.1, filed Jul. 25, 2013, the entire disclosure of which is herein expressly incorporated by reference.

BACKGROUND AND SUMMARY OF THE INVENTION

Exemplary embodiments of the invention relate to a waveguide radiator having a slotted waveguide with a plurality of slots provided in the waveguide. Exemplary embodiments of the invention further relate to an array antenna radiator and a synthetic aperture radar system.

Waveguide radiators or array antenna radiators (in the literature also referred to as radiators or subarrays) are used, for example, in phased-array antennas of synthetic aperture radar (SAR) systems with single or dual polarization. Up to now, so-called microstrip patch antennas or slotted waveguide antennas are used as radiators.

Microstrip patch antennas exhibit high electrical losses and, due to their electrical feed network, cannot be efficiently implemented in greater radiator lengths than approximately seven wavelengths (in the X-band approximately 20 cm). In the case of an active antenna with distributed generation of the HF transmitting power by so-called T/R modules (transmit/receive modules) there is also the problem of dissipating the heat of the active modules, which are located on the rear side of the radiators, to the front.

The slotted waveguide antennas, on the other hand, are limited by their electrically resonant behavior in the achievable relative bandwidth (<5%). Moreover, they require high manufacturing accuracy and can be produced as dual-polarized array antennas only with very high costs. Concepts used in the prior art are waveguides with inner webs and longitudinal slots for vertical polarization, and rectangular waveguides with diagonally inserted wires and transversal slots for horizontal polarization. The problem here is the required transitions of the connected coaxial cables into the waveguides.

German patent document DE 10 2006 057 144 A1 discloses a waveguide radiator comprising a slotted waveguide in which an additional inner conductor, a so-called barline, is provided. This inner conductor is specially shaped in a polarization-dependent manner in order to excite all slots of the waveguide with identical phase. In contrast to conventional slotted waveguides, the propagation modes are no longer dispersive but correspond to those in coaxial lines, i.e., TEM modes. Hereby, the bandwidth can increase. Moreover, the cross-sections of the waveguides can be considerably reduced in size since no lower limiting frequency (so-called cutoff frequency) exists in the case of TEM modes. Coupling can take place by a direct coaxial transition, which can be implemented in a mechanically simple manner, for example by commercially available SMA installation sockets.

Exemplary embodiments of the invention are directed to a waveguide radiator that is functionally and/or structurally improved. The waveguide radiator is broadband and is producible in an efficient and cost-effective manner so that that it can be used for building a planar array antenna that can be used in space-based or aircraft-based synthetic aperture radar (SAR) systems.

In accordance with exemplary embodiments of the invention a waveguide radiator comprises a slotted waveguide radiator (waveguide) having a plurality of transversal or longitudinal slots provided in the waveguide. If the waveguide has transversal slots, the direction of the radiated polarization of the waveguide corresponds to the longitudinal direction of the waveguide. If the slotted waveguide has longitudinal slots, the direction of the radiated polarization of the waveguide corresponds to the transverse direction of the waveguide. Depending on the alignment of the slots, thus, either horizontally or vertically polarized waves can be radiated. The additional inner conductor fitted in the waveguide is shaped independently of the alignment of the slots in such a manner that the result is a feed according to the traveling wave principle, wherein all slots of the waveguide can be excited with identical phase.

Due to the inner conductor (so-called barline) located in the interior of the waveguide, a dispersion-free, transversal electromagnetic propagation mode (TEM mode) is supported. The inner conductor is shaped in a polarization-dependent manner to be specifically able to excite either longitudinal or transversal slots. Compared to the waveguide radiator described in German patent document DE 10 2006 057 144 A1, the waveguide radiator of the present invention has a significantly greater bandwidth.

In order to secure the inner conductor, a layer of dielectric material is placed in the waveguide, on the surface of which the inner conductor is fitted, for example by adhesive bonding.

The height or thickness of the dielectric layer along the waveguide is not uniform but has an individually shaped height profile. By means of the height profile and the shape of the inner conductor, the amplitude and phase of the electric field strength in the slots along the waveguide can be specifically influenced so that any desired aperture illuminations can be implemented, for example, in order suppress side lobes in the antenna radiation pattern below a predetermined value. In the same manner, a homogenous amplitude and phase occupancy along the waveguide can be achieved, for example, in order to maximize the antenna gain and to minimize the full width half maximum.

Each slot of the waveguide radiator can have individual geometric dimensions. However, it is to be understood that the waveguide radiator can have either only longitudinal or only transversal slots.

The specific shape of the inner conductor is composed of repetitive sections of similar geometry along the waveguide. The length of these sections is identical here to the spacing of adjacent slots along the waveguide. The additional inner conductor can be formed in particular from alternately arranged straight and twisted conductor sections.

One firm with respect to the resonant feed with a standing wave is an additional quarter-wave transformer that is located in each of the repetitive sections. This quarter-wave transformer is implemented by tapering the inner conductor, i.e., reducing the conductor width. The length of this taper or the conductor width reduction is preferably selected such that it corresponds to an electrical path length of exactly the quarter of a line wavelength. The reduction of the conductor width effects an increase of the wave impedance along the tapered section. By the quarter-wave transformers implemented in this manner, reflection points are compensated which otherwise would occur at these positions.

In the region of the ends of the waveguide, the inner conductor can have a straight section as an open stub.

While the radiator described in German patent document DE 10 2006 057 144 A1 uses a feed with standing wave, the waveguide according to the invention uses a so-called traveling wave feed.

Coupling a signal can take place in the center of the waveguide radiator by a galvanically coupled coaxial transition, wherein the inner conductor of a connected coaxial cable (e.g., via SMA, SMP connection) is directly connected to the feed point of the inner conductor. The outer conductor of the connected coaxial cable is directly connected to the wall of the waveguide.

The feed point can be slightly shifted in the transverse direction so as to thereby enable the transition at a suitable place to a circuit board attached on the rear side of the radiator.

In the case of slotted waveguide having transverse slots, the feed point of the waveguide can be shifted with respect to the geometric center of the waveguide in the longitudinal direction. In a specific implementation, the shift can be approximately 6 to 7 mm, wherein said shift depends on the wavelength or frequency of the signal to be generated.

In another configuration of a slotted waveguide having transverse slots, the feed point of the waveguide can be arranged in the waveguide in such a manner that the electric phase at the positions of slots is identical at center frequency.

In the case of a slotted waveguide having longitudinal slots, the additional inner conductor has a feed point which, in the longitudinal direction of the slotted waveguide, is arranged in the geometric center. It can also be provided that the slotted waveguide with the additional inner conductor is formed mirror-symmetrically around the feed point.

Overall, it is achieved that the wave fed at the feed point of the radiator can propagate in the center of the radiator without reflection up to the ends of the inner conductor.

The invention has the advantage that in contrast to the resonant feed, significantly greater band widths can be implemented. The advantages mentioned in German patent document DE 10 2006 057 144 A1 regarding conventional slotted waveguides remain valid such as, e.g., no dispersion, size reduction of the cross-section, no cutoff frequency, robustness with respect to manufacturing tolerances, possibility of greater radiator lengths, low production costs, short production time, problem-free transition to coaxial cable, high power can be fed, low ohmic losses, high cross-polar suppression.

Developing the waveguide radiators, in particular determining the exact geometric dimensions of the inner conductor and the slots is performed by means of electromagnetic simulation methods. The behavior of the radiator described here can also approximately be described by network models with suitable equivalent circuit diagrams. These models are normally used in a first step in order to optimize the dimensions of the elements present in the equivalent circuit diagram. In the second step, these dimensions are then translated into suitable geometric parameters. For this, commercially available software packets can be used that calculate the electromagnetic behavior of the actual geometry (3D model) by means of a flu wave analysis.

An array antenna radiator according to the invention comprises one or a plurality of slotted waveguides having transverse slots and one or a plurality of slotted waveguides having longitudinal slots of the kind described above. In one configuration, the slotted waveguides can be arranged side-by-side in the transverse direction, wherein a waveguide having transverse slots and a waveguide having longitudinal slots alternately adjoin each other. Here, the waveguides, i.e., all waveguides, preferably have an identical length.

The waveguides having transverse slots can be offset upwards with respect to the waveguides having longitudinal slots so that a step-like structure of the array antenna radiator is created. The top side here is that side of a respective waveguide on which the slots are located on the waveguides.

A synthetic aperture radar system, in particular a high-resolution synthetic aperture radar system comprises at least one array antenna radiator of the above-described kind.

BRIEF DESCRIPTION OF THE INVENTION

The invention is explained in greater detail below by means of exemplary embodiments in the drawing. In the figures.

Figure 1:
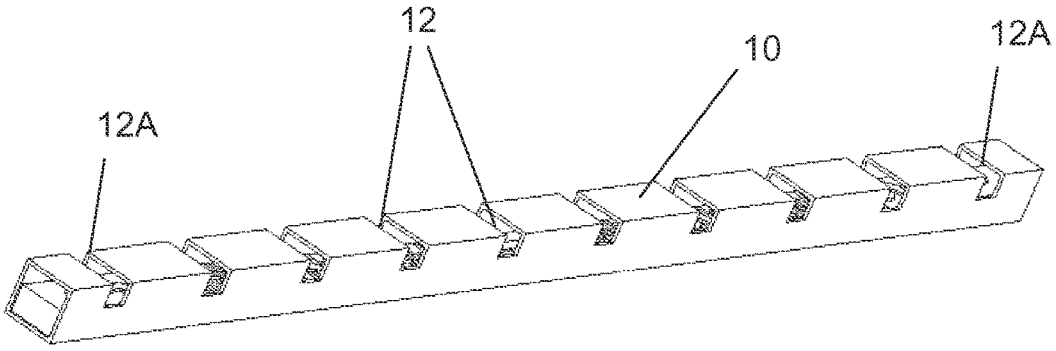
FIG. 1 shows an illustration of the waveguide radiator according to the invention having transverse slots.

The absolute values and dimensions indicated below are merely exemplary values and do not limit the invention in any way to such dimensions. The illustrations show the invention only schematically and are in particular not to be considered as being true to scale.

DETAILED DESCRIPTION

Hereinafter, the structure of the waveguide radiator (in short: radiator) according to the invention comprising a slotted waveguide (hereinafter designated as waveguide 10, 30) and an inner conductor 14, 34 arranged in the wave guide 10, 30 is described. A differentiation is made here between slotted waveguides 10, 30 having transverse slots 12 (FIG. 1) and longitudinal slots (32) (FIG. 6), in which the shape of the inner conductors 14 and 34 used is different. The exact configuration of the inner conductor 34 for the waveguide 30 having transverse slots 32 is illustrated in the FIGS. 8 to 10.

The geometric dimensions indicated below relate to an exemplary embodiment in the X-band at a center frequency of 9.6 GHz. The radiator described here can readily also be designed for different center frequencies. In this case, the dimensions are scaled via the ratio of the corresponding wavelengths.

The waveguides 10, 30 are formed from conventional rectangular waveguides in which transverse slots 12 or longitudinal slots 32 are provided. The inside of the waveguide 10, 30 is filled with a dielectric material. The dielectric layer 24, 44 is illustrated in the FIGS. 2 and 7. While radiators according to the prior art have a constant layer thickness, the dielectric layers 24, 44 of the invention have a variable height or thickness in the longitudinal extent of the waveguide.

The selection of the material used for the dielectric layer is determined by the electrical properties thereof, namely the relative permittivity and the loss angle. The relative permittivity influences the propagation speed of the traveling wave running on the inner conductor (velocity factor). The spacing between adjacent slots along the waveguide for achieving excitation with identical phase corresponds exactly to one wavelength of the traveling wave. Moreover, the slot spacing is smaller than a free-space wavelength in order to avoid undesirable side lobes (so-called grating lobes). Typically, the slot spacing lies in the range of the 0.5-fold to 0.9-fold of a free-space wavelength. As a result, the value of the relative permittivity is obtained, which therefore typically lies in the range of from 1.2 to 3.0. The loss angle should be as small as possible in order to keep the dielectric loss as small as possible; for a suitable material, the value should be less than $1 \cdot 10^{-3}$.

The thickness of the dielectric layer 24, 44 along the waveguide has a characteristic profile. The height at the positions of the slots 12, 32 determines the portion of the coupled-out power of the traveling wave. A greater height results in more intense coupling out and vice versa in the case of a lower height.

Figure 2:
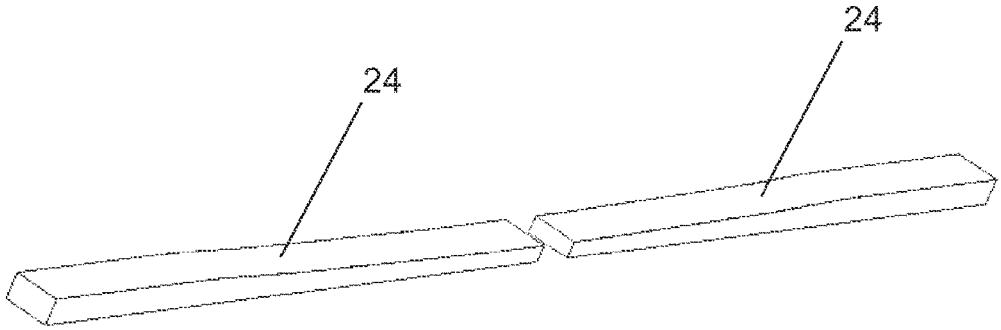
FIG. 2 shows a height profile of a dielectric layer arranged inside the waveguide from FIG. 1.
Figure 7:
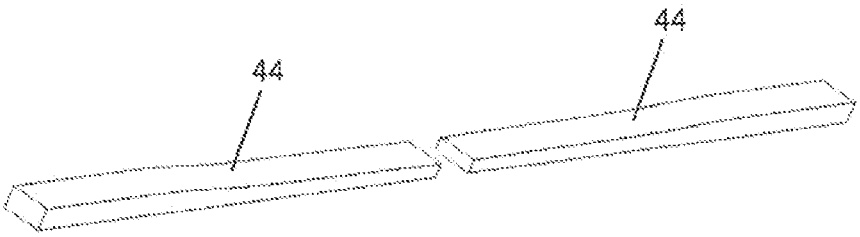
FIG. 7 shows a height profile of a dielectric layer arranged inside the waveguide from FIG. 6.

The example illustrated in the FIGS. 2 and 7 shows the case of a homogenous excitation of all slots 12, 32. The thickness of the dielectric layer 24, 44 increases in this case towards the outer ends of the respective waveguide 10, 30 since a steadily increasing relative proportion has to be coupled out from the decreasing power of the traveling wave.

Figure 4:
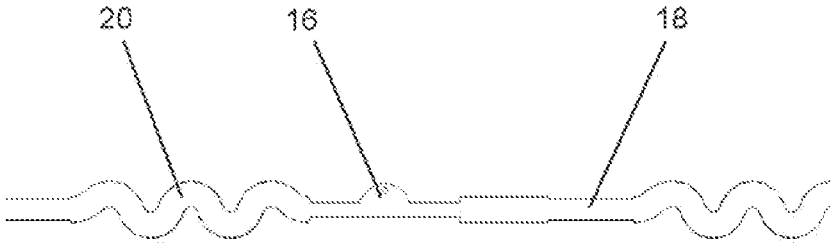
FIG. 4 shows an enlarged illustration of the central region of the inner conductor from FIG. 3.
Figure 8:
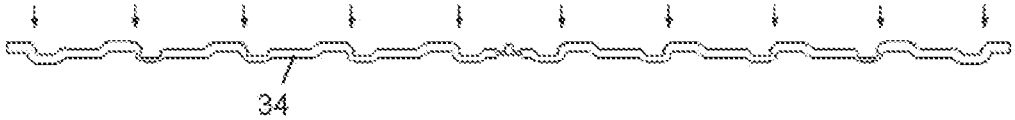
FIG. 8 shows an illustration of the shape of the inner conductor (barline) in the waveguide radiator having longitudinal slots from FIG. 6.
Figure 9:
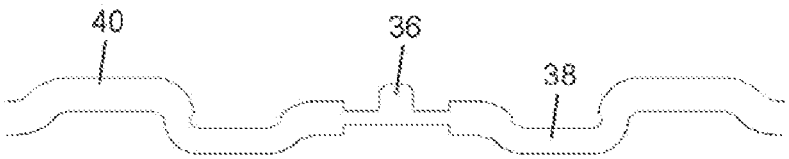
FIG. 9 shows an enlarged illustration of the central region of the inner conductor from FIG. 8.

As is apparent from the following description, another commonality of the two variants is that the inner conductor 14, 34 has sub-sections with reduced conductor width 18 and 38 (cf. FIGS. 4 and 8). They act as transformation lines and prevent the occurrence of reflections (standing wave) on the line.

Hereinafter, the features of the waveguide having transverse slots and of the waveguide having longitudinal slots are described separately:

Waveguide Having Transverse Slots

Figure 3:
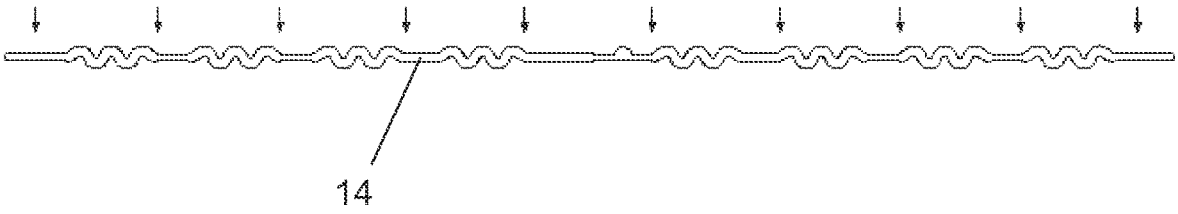
FIG. 3 shows an illustration of the shape of the inner conductor (barline) in the waveguide having transverse slots from FIG. 1.

FIG. 1 shows a waveguide 10 having transverse slots 12. The shape of the inner conductor 14 in the waveguide 10 having transverse slots 12 is illustrated in FIG. 3. The positions of the slots are indicated in FIG. 3 by arrows. The central region that includes a feed point 16 is illustrated enlarged in FIG. 4. The feed point 16 is shifted with respect to the geometric center by approximately 6 mm in the longitudinal direction. This shift effects a phase difference of 180° of the traveling wave extending from the feed point into the right and left parts of the waveguide 10. In this manner, excitation with identical phase of the slots in the right as well as the left part of the waveguide 10 is obtained.

The inner conductor 14 begins directly at the feed point 16 with sections 18 (transformation lines) with reduced conductor width. They serve for transformation to the characteristic wave impedance of the connected coaxial cables of typically 50 Ohm, which are not illustrated here in detail. The further course of the inner conductor 14 towards the ends of the waveguide 10 consists of straight sections 18 with reduced conductor width and twisted sections 20. The straight sections thus act as transformation lines. The twisting of the remaining sections 20 effects a delay in the propagation speed of the traveling wave in the longitudinal direction of the waveguide 10. A higher degree of twisting results in a greater delay and vice versa. Through this, the phase difference between adjacent slots 12 can be set to exactly 360°.

The slots 12 are cut in the transverse direction into the outer wall of the waveguide 10. They protrude into the lateral walls with a cutting depth of approximately 4 mm. The width of the slots 12 is approximately 2-3 mm. The slots 12 exhibit a resonant behavior; the resonant frequency coincides with the center frequency of the radiator.

Figure 5:
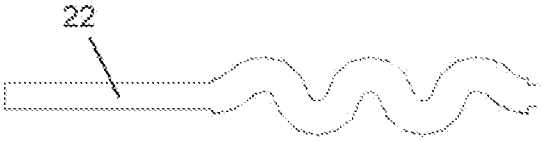
FIG. 5 shows an enlarged illustration of the region of the ends of the inner conductor from FIG. 3.

The outermost slot 12A at the ends of the waveguide 10 with the section 22 of the waveguide 10 located therebelow shows a particular feature. According to the prior art, the ends of the traveling wave lines are often terminated resistively. This results in undesirable losses since the power remaining at the end of the line is dissipated in a resistor. In the concept introduced here of a traveling wave radiator with homogenous excitation of all slots, power remaining at the end of the line is completely radiated via the outermost slot, as a result of which additional losses are avoided. For this purpose, the height profile of the dielectric layer is designed such that power remaining at the outermost slot 12A corresponds to the power coupled out at the remaining slots, so that by adhering to this boundary condition, homogenous occupancy of all slots 12, 12A is achieved. In this connection, FIG. 5 shows an enlarged illustration of the region of the ends of the inner conductor from FIG. 3, wherein the non-twisted open line end with the section 22 can be seen, which supports the described properties.

Waveguide Having Longitudinal Slots

Figure 6:
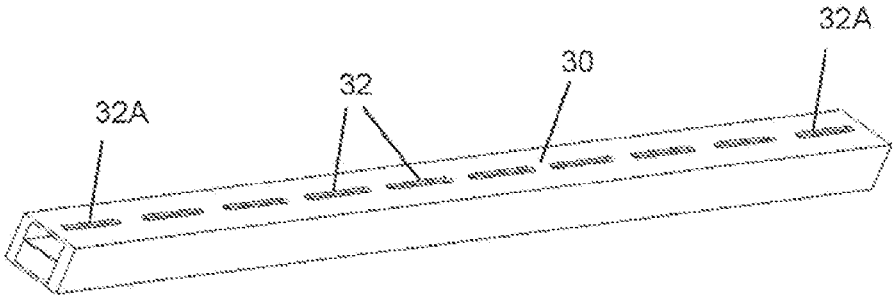
FIG. 6 shows an illustration of a waveguide radiator according to the invention having longitudinal slots.

FIG. 6 shows a waveguide 30 having longitudinal slots. The shape of the inner conductor 34 in a waveguide having longitudinal slots 30 is illustrated in FIG. 8. The central region that includes the feed point 36 is illustrated enlarged in FIG. 9. Viewed in the longitudinal direction, the feed point 36 is located in the geometrical center. Shifting in the longitudinal direction, as in the case of a waveguide having transverse slots, is not required in this case since excitation of the slots 32 with identical phase can be achieved by the symmetric structure of the right and left halves of the waveguide 30.

The inner conductor 34 begins directly at the feed point 36 with transformation lines of reduced conductor width. They serve for transformation to the characteristic wave impedance of the connected coaxial cable of typically 50 Ohm. The further course of the inner conductor 34 to the ends of the waveguide consists of straight sections 38 and twisted sections 40. The twisted shape of the sections 40 is embodied in such a manner that the inner conductor runs in the transverse direction at the central positions of the slots 32. This is necessary for coupling the longitudinal slots 32, because for this, a flow of the induced current in the transverse direction has to be present on the wall of the waveguide 30. The position of the slots in FIG. 8 is indicated by arrows.

The twisted shape of the sections 40 effects in addition a delay of the propagation speed of the traveling wave in the longitudinal direction of the waveguide. A more twisted shape effects a greater delay and vice versa. Through this, the phase difference between adjacent slots can be set to exactly 360°.

The slots 32 are out in the longitudinal direction into the outer wall of the waveguide 30. The slots 32 have a length of approximately half of the free-space wavelength. The exact length can vary slightly from slot to slot. The width of the slots is approximately 2 mm. The slots exhibit resonant behavior; the resonant frequency coincides with the center frequency of the radiator.

Figure 10:
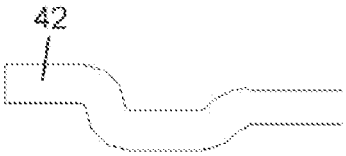
FIG. 10 shows an enlarged illustration of the region of the ends of the inner conductor from FIG. 8.

The outermost slot 32A at the ends of the waveguide 30 with the section 42 of the inner conductor 42 located therebelow shows a particular feature. According to the prior art, the ends of the traveling wave line are often resistively terminated in radiators using the traveling wave principle. This results in undesirable losses since the power remaining at the end of the line is dissipated in a resistor. In the concept introduced here of a traveling wave radiator with homogenous excitation of all slots 32, power remaining at the end of the line is completely radiated via the outermost slot 32A, as a result of which additional losses are avoided. For this purpose, the height profile of the dielectric layer 44 is designed such that power remaining at the outermost slot 32A corresponds to the power coupled out at the remaining slots 32, so that by adhering to this boundary condition, homogenous occupancy of all slots 32, 32A can be achieved. FIG. 10 shows an enlarged illustration of the region of the ends of the inner conductor from FIG. 8. The non-twisted open line end with the section 42 of the inner conductor 34, which supports the described properties, can be seen.

Dual-Polarized Radiator Array

By combining a waveguide 10 having transverse slots with a waveguide 30 having longitudinal slots, dual-polarized radiator arrays 60 can be implemented in a simple manner. Since the widths of the waveguides can be greatly reduced (up to a fourth of the wavelength) with the radiator concept described here, dual-polarized electronically controllable array antennas with very large pivoting range (>±60°) can be implemented.

Figure 11:
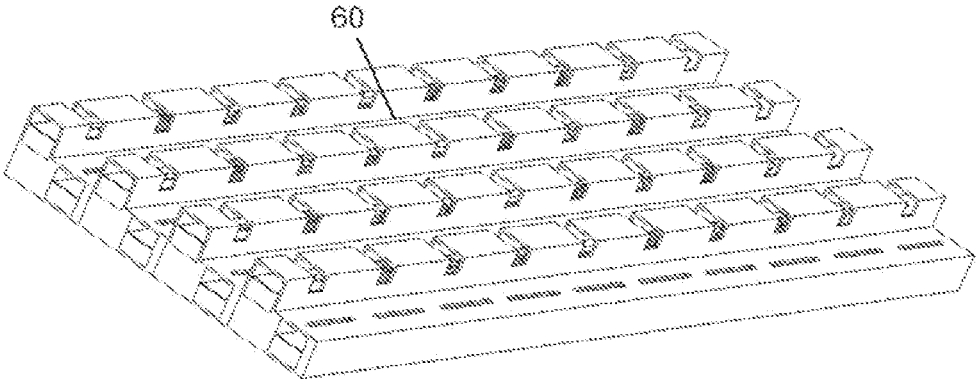
FIG. 11 shows a dual-polarized array antenna radiator from a combination of waveguides having transverse slots and waveguides having longitudinal slots.

FIG. 11 shows the structure of a dual-polarized radiator array 60 (array antenna radiator). It consists of a composition of a slotted waveguides 10 having transverse slots 12 that alternate in each case with waveguides 30 having longitudinal slots 32. The waveguides 10 having transverse slots 12 are offset upwards with respect to the waveguides 30 having longitudinal slots 12 by approximately 7 mm to 8 mm so that a step-like structure is created.

Compared to the waveguide radiators known from the prior art, the proposed waveguide radiator is characterized by a bandwidth that is significantly increased again. This is illustrated by way of example in the FIGS. 12 to 15 for a radiator of the length 250 mm for the X-band.

Figure 12:
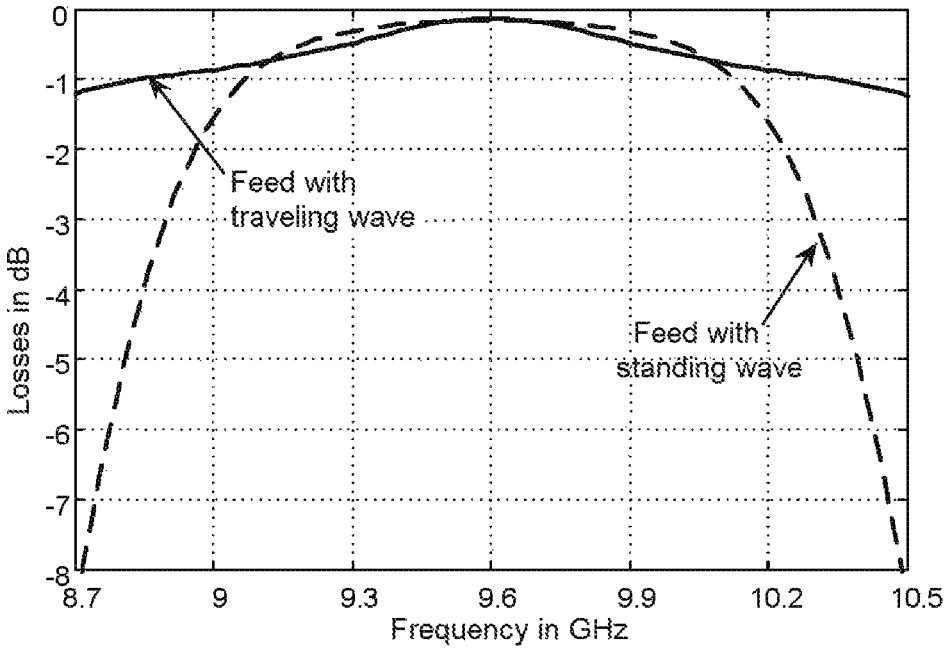
FIG. 12 shows a graphical representation of the overall losses in dB occurring in the radiator compared to an ideal aperture of the same size.

FIG. 12 shows an illustration of the overall electrical losses in dB occurring in the radiator compared to an ideal aperture of the same size. The curve drawn with a solid line represents losses of the radiator with traveling wave feed, and the curve drawn with a dashed line represents losses at resonant feed with standing wave.

Figure 13:
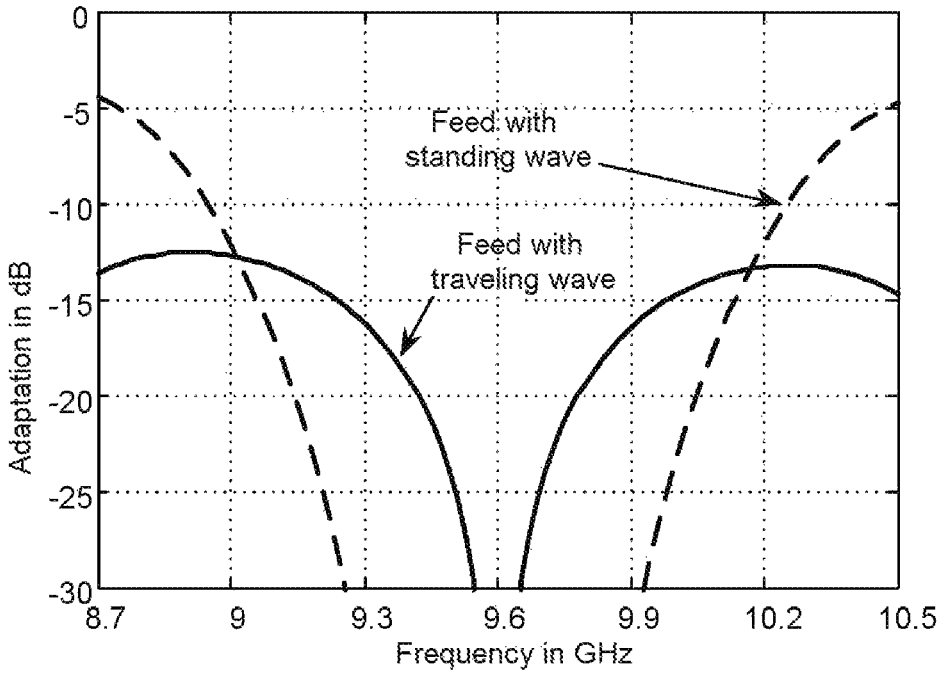
FIG. 13 shows a graphical representation of the adaptation in dB.

FIG. 13 shows an illustration of the adaptation in dB, wherein the curve with solid line is to be associated with a radiator with traveling wave feed and the curve with dashed line is to be associated with a radiator with resonant feed (standing wave).

Figure 14:
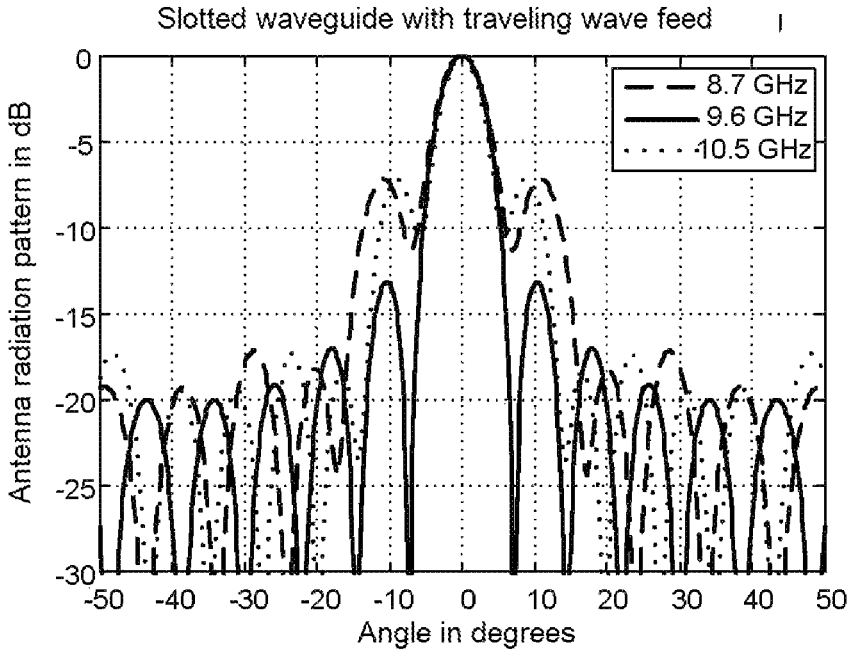
FIG. 14 shows a graphical representation of the radiation properties in dB (antenna radiation pattern) of a radiator with traveling wave feed.

FIG. 14 shows an illustration of the radiation properties in dB (antenna radiation pattern) of a radiator with traveling wave feed, wherein the curve with the dashed line shows the antenna radiation pattern at 8.7 GHz, the curve with the solid line shows the antenna pattern at 9.6 GHz (center frequency) and the curve with the dotted line shows the antenna radiation pattern at 10.5 GHz.

Figure 15:
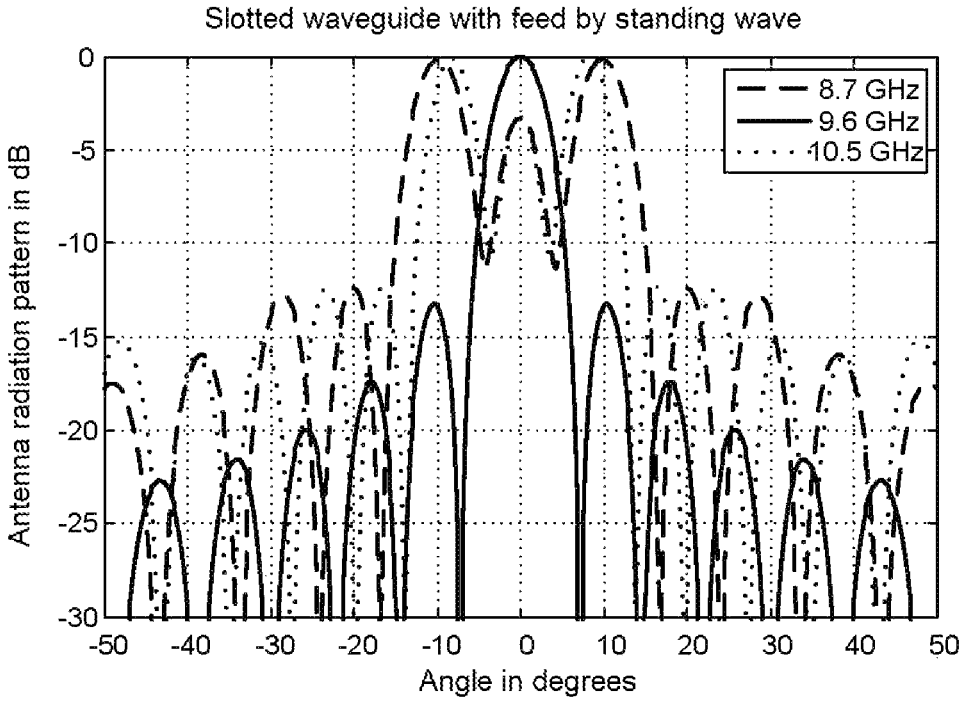
FIG. 15 shows a graphical representation of the radiation properties in dB (antenna radiation pattern) of a radiator with resonant feed and standing wave.

FIG. 15 finally shows at illustration of the radiation properties in dB (antenna radiation pattern) of a radiator with resonant feed and standing wave, wherein the curve with the dashed line shows the antenna radiation pattern at 8.7 GHz, the curve with the solid line shows the antenna radiation pattern at 9.6 GHz (center frequency) and the curve with the dotted line shows the antenna radiation pattern at 10.5 GHz.

The foregoing disclosure has been set forth merely to illustrate the invention and is not intended to be limiting. Since modifications of the disclosed embodiments incorporating the spirit and substance of the invention may occur to persons skilled in the art, the invention should be construed to include everything within the scope of the appended claims and equivalents thereof.

REFERENCE LIST

10 slotted waveguide having transverse slots
12 transverse slot
12A transverse slot at the end of the waveguide
14 inner conductor of the waveguide having transverse slots
16 feed point of the waveguide having transverse slots
18 transformation line section of the inner conductor (waveguide having transverse slots)
20 twisted sub-section of the inner conductor (waveguide having transverse slots)
22 end section of the inner conductor with open stub (waveguide having transverse slots)
24 dielectric layer of the waveguide having transverse slots
30 slotted waveguide having longitudinal slots
32 longitudinal slot
32A longitudinal slot at the end of the waveguide
34 inner conductor of the waveguide having longitudinal slots
36 feed point of the waveguide having longitudinal slots
38 transformation line section of the inner conductor (waveguide having longitudinal slots)
40 twisted sub-section of the inner conductor (waveguide having longitudinal slots)
42 end section of the inner conductor with open stub (waveguide with longitudinal slots)
44 dielectric layer of the waveguide having longitudinal slots
60 dual-polarized radiator array

What is claimed is:

1. A waveguide radiator, comprising a slotted waveguide having a plurality of longitudinal slots provided in the slotted waveguide; and an additional inner conductor arranged in the slotted waveguide, wherein the additional inner conductor is configured, depending on the alignment of the slots, in such a manner that a result is a feed according to the traveling wave principle, wherein all slots of the waveguide are excited with identical phase, wherein the slotted waveguide is partially filled with a dielectric material on which the additional inner conductor is arranged, and wherein the additional inner conductor comprises more than two straight conductor sections, which are spaced apart from each other by respective twisted sections, and which, with respect to the twisted sections, have a reduced conductor width and act as transformation lines, wherein a height of the dielectric material longitudinally along the waveguide varies at least in certain sections, thereby influencing an amplitude occupancy of the slots along the waveguide such that power remaining at an outermost slot of the plurality of longitudinal slots corresponds to power coupled at a remaining of the plurality of longitudinal slots, wherein the additional inner conductor has a feed point which, in a longitudinal direction of the slotted waveguide, is arranged in a geometric center, and wherein the slotted waveguide with the additional inner conductor is formed mirror-symmetrically around the feed point.

2. The waveguide radiator of claim 1, wherein the additional inner conductor is formed from alternately arranged straight and twisted conductor sections.

3. The waveguide radiator of claim 1, wherein the additional inner conductor is composed of repetitive line sections along the slotted waveguide, wherein a length of the repetitive line sections is identical to a spacing of adjacent slots along the slotted waveguide.

4. The waveguide radiator of claim 1, wherein the additional inner conductor has a straight section as open stub in a region of ends of the slotted waveguide.

5. The waveguide radiator of claim 1, wherein the slotted waveguide has transverse slots, and wherein a feed point of the slotted waveguide is shifted with respect to a geometric center of the slotted waveguide in a longitudinal direction.

6. The waveguide radiator of claim 1, wherein the slotted waveguide has transverse slots, and wherein a feed point of the slotted waveguide is arranged in the slotted waveguide in such a manner that an electric phase at positions of all slots is identical at center frequency.

7. An array antenna radiator, comprising:

one or more first slotted waveguides, including:

a plurality of transverse slots provided in the first slotted waveguides; and an additional first inner conductor arranged in the first slotted waveguides, wherein the additional first inner conductor is configured, depending on alignment of the transverse slots, in such a manner that a result is a feed according to the traveling wave principle, wherein all transverse slots of the one or more first waveguides are excited with identical phase; and one or more second slotted waveguides, including:

a plurality of longitudinal slots provided in the second slotted waveguides; and an additional second inner conductor arranged in the second slotted waveguides, wherein the additional second inner conductor is configured, depending on alignment of the longitudinal slots, in such a manner that a result is a feed according to the traveling wave principle, wherein all longitudinal slots of the one or more second waveguides are excited with identical phase, wherein the first and second slotted waveguides are each partially filled with a dielectric material on which the respective additional inner conductor is arranged, wherein a height of the dielectric material longitudinally along the respective waveguide varies at least in certain sections, thereby influencing an amplitude occupancy of the slots along the respective waveguide such that power remaining at an outermost slot of the plurality of respective transversal or longitudinal slots corresponds to power coupled at a remaining of the plurality of respective transversal or longitudinal slots, wherein each of the additional first and second inner conductors comprises more than two conductor sections which are spaced apart from each other by respective intermediate sections and which, with respect to the intermediate sections, have a reduced conductor width and act as transformation lines, wherein each additional inner conductor has a feed point which, in a longitudinal direction of the respective slotted waveguide, is arranged in a geometric center, and wherein each slotted waveguide with the respective additional inner conductor is formed mirror-symmetrically around the feed point.

8. The array antenna radiator of claim 7, wherein the one or more first and second slotted waveguides are arranged side-by-side in a transverse direction, wherein a waveguide having transverse slots and a waveguide having longitudinal slots lie alternately next to one another.

9. The array antenna radiator of claim 7, wherein the one or more first and second slotted waveguides have identical lengths.

10. The array antenna radiator of 7, wherein the one or more first waveguides are offset upwards with respect to the one or more second waveguides to form a step-like structure of the array antenna radiator.

11. A high-resolution synthetic aperture radar system, comprising:

an array antenna radiator, which comprises:

one or more first slotted waveguides, including:

a plurality of transverse slots provided in the first slotted waveguides; and an additional first inner conductor arranged in the first slotted waveguides, wherein the additional first inner conductor is configured, depending on alignment of the transverse slots, in such a manner that a result is a feed according to the traveling wave principle, wherein all transverse slots of the one or more first waveguides are excited with identical phase; and one or more second slotted waveguides, including:

a plurality of longitudinal slots provided in the second slotted waveguides; and an additional second inner conductor arranged in the second slotted waveguides, wherein the additional second inner conductor is configured, depending on alignment of the longitudinal slots, in such a manner that a result is a feed according to the traveling wave principle, wherein all longitudinal slots of the one or more second waveguides are excited with identical phase, wherein the first and second slotted waveguides are each partially filled with a dielectric material on which the respective additional inner conductor is arranged, wherein a height of the dielectric material longitudinally along the respective waveguide varies at least in certain sections, thereby influencing an amplitude occupancy of the slots along the waveguide such that power remaining at an outermost slot of the plurality of respective transversal or longitudinal slots corresponds to power coupled at a remaining of the plurality of transversal or longitudinal slots, wherein each of the additional first and second inner conductors comprises more than two conductor sections which are spaced apart from each other by respective intermediate sections and which, with respect to the intermediate sections, have a reduced conductor width and act as transformation lines, wherein each additional inner conductor has a feed point which, in a longitudinal direction of the respective slotted waveguide, is arranged in a geometric center, and wherein each slotted waveguide with the respective additional inner conductor is formed mirror-symmetrically around the feed point.

* * * * *